US007096539B2

(12) United States Patent
Muir

(10) Patent No.: US 7,096,539 B2
(45) Date of Patent: Aug. 29, 2006

(54) SHIM ASSEMBLY FOR RELEASABLY ENGAGING A HINGE ASSEMBLY

(75) Inventor: Malcolm Muir, Honeoye Falls, NY (US)

(73) Assignee: Advantage Manufacturing Corporation, Victor, NY (US)

( * ) Notice: Subject to any disclaimer, the term of this patent is extended or adjusted under 35 U.S.C. 154(b) by 0 days.

(21) Appl. No.: 10/822,624

(22) Filed: Apr. 12, 2004

(65) Prior Publication Data

US 2005/0223524 A1 Oct. 13, 2005

(51) Int. Cl.
*E05D 3/06* (2006.01)

(52) U.S. Cl. ..... 16/366; 16/247

(58) Field of Classification Search ..... 16/366, 16/382, 247, 242, 388; 312/326; 49/248–252, 49/452, 181

See application file for complete search history.

(56) References Cited

U.S. PATENT DOCUMENTS 2,154,716 A * 4/1939 Anderson ..... 16/247
3,229,323 A * 1/1966 Hensgen ..... 16/247
3,413,761 A * 12/1968 Proni ..... 49/396
4,304,027 A * 12/1981 Di Fazio ..... 16/249
4,635,399 A * 1/1987 Gehrke et al. ..... 49/460
4,639,971 A * 2/1987 Kurtz ..... 16/247
4,662,553 A * 5/1987 Grosjean ..... 225/103
4,790,106 A * 12/1988 La See ..... 49/252
5,074,075 A * 12/1991 La See ..... 49/252
5,491,930 A * 2/1996 La See ..... 49/252
5,640,813 A * 6/1997 Glazik et al. ..... 52/126.1
5,815,992 A * 10/1998 Wells et al. ..... 52/126.1
5,898,977 A 5/1999 Muir
6,560,934 B1 * 5/2003 Workman ..... 52/126.1

FOREIGN PATENT DOCUMENTS

GB 2184481 A * 6/1987
GB 2233706 A * 1/1991
GB 2258267 A * 2/1993
GB 2318613 A * 4/1998

* cited by examiner

*Primary Examiner*—Chuck Y. Mah
(74) *Attorney, Agent, or Firm*—Brian B. Shaw, Esq.; Stephen B. Salai, Esq.; Harter, Secrest & Emery LLP

(57) ABSTRACT

A shim assembly is constructed for engaging a hinge assembly to allow operable installation of the hinge assembly in an otherwise oversized sash-frame cavity. A shim body can include at least one projecting tab for engaging a vent bar of the hinge assembly, wherein the projecting tab can be integrally formed with the shim body. Alternatively, snap rivets can be used to engage the shim body with the vent bar.

16 Claims, 9 Drawing Sheets

SHIM ASSEMBLY FOR RELEASABLY ENGAGING A HINGE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to hinge assemblies for interconnecting a sash and a surrounding frame and, more particularly, to a shim assembly for releasably engaging the hinge assembly, the hinge assembly designed for a first sash-frame cavity, and the shim assembly constructed to allow the hinge assembly to operably interconnect a different size sash-frame cavity.

2. Description of Related Art

In many window assemblies, it is often desirable to have a sash be movable relative to a frame. Typically, the relative movement is provided by a hinge assembly operably connected to the sash and the frame. In construction, the sash is spaced from the frame to define a cavity or available hinge space. The cavity is sized to permit opening and closure of the sash. In addition, the sash-frame cavity is often sized to accommodate locking hardware and weatherseal contact and prevent interference.

Typically, a given hinge assembly is sized and constructed to accommodate a given sash-frame cavity size. That is, the linkages and pivoting movement within the hinge assembly require the sash to move within a predetermined range or path. If a hinge assembly is connected to a sash and frame outside of the design parameters, premature hinge failure results.

Therefore, the industry practice has been to stock an inventory of hinge assemblies for each anticipated sash-frame cavity size. Thus, substantial inventories can exist, wherein these inventories unnecessarily add to the overhead costs of window manufacturers.

Therefore, the need exists for a shim assembly that can engage a hinge assembly to allow operation of the hinge assembly (designed for a first sash-frame cavity size) in a different second sash-frame cavity size. The need also exists for a shim assembly that can be readily engaged with the hinge assembly, without requiring machinery or specialized tooling.

BRIEF SUMMARY OF THE INVENTION

The present invention provides a shim assembly for engaging a hinge assembly, the hinge assembly designed for operation in a first sash-frame cavity, to allow operable engagement of the hinge assembly in a different (larger) sash-frame cavity.

In a first configuration, the shim assembly includes an elongate shim body and a pair of integral projecting tabs, wherein at least one of the tabs is sized to form an interference fit with a corresponding aperture in the hinge assembly. One of the tabs can have a circular cross section, and one of the tabs can have a non circular cross section, such as an obround cross section. The tabs can be received within correspondingly shaped apertures in the hinge assembly. Alternatively, both tabs (circular and non circular cross section) can be received within circular apertures in the hinge assembly. It is further contemplated the hinge assembly can include a circular aperture and a spaced obround aperture, wherein the first tab is sized to be received within the circular aperture and a second tab is an obround cross section sized to be received within the obround aperture of the hinge assembly.

In a further configuration, the shim body can be connected to the hinge assembly by at least one snap rivet. It is contemplated a pair of snap rivets can be used to engage the shim body to the hinge assembly. However, it is also understood that an integral tab and a snap rivet can be used to connect the shim body to the hinge assembly.

BRIEF DESCRIPTION OF THE SEVERAL VIEWS OF THE DRAWING(S)

DETAILED DESCRIPTION OF THE INVENTION

Figure 1:
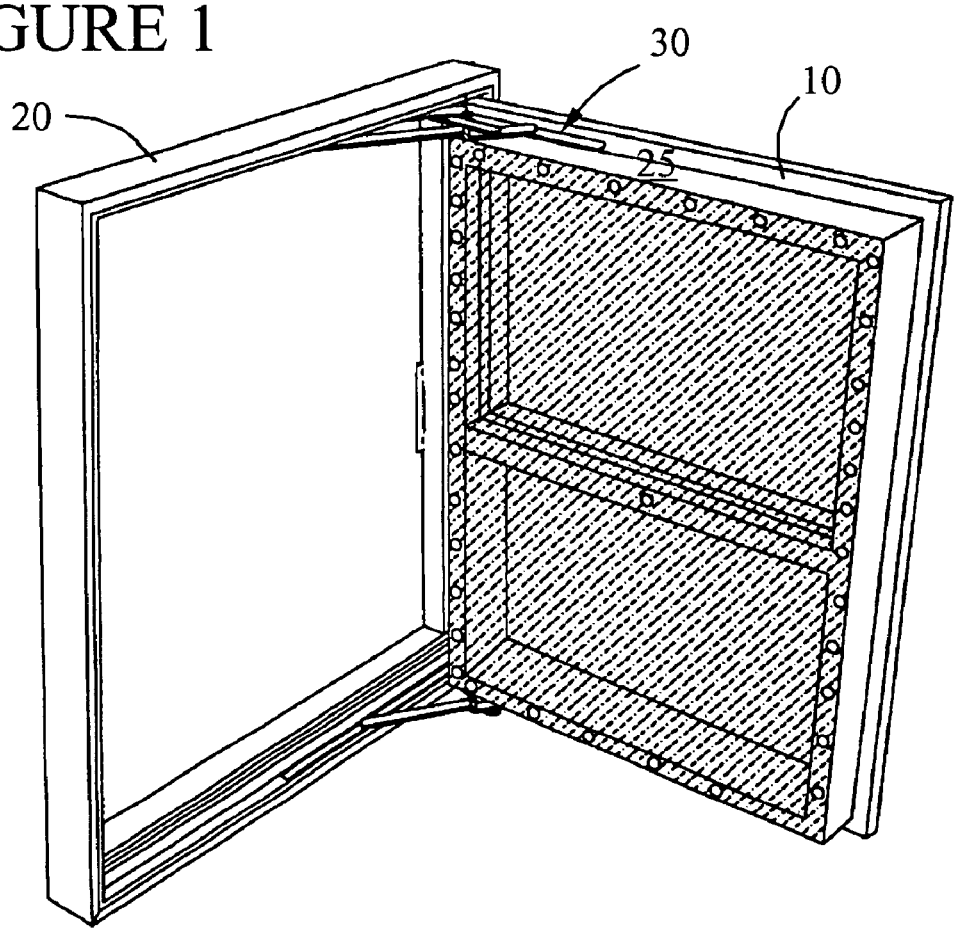
FIG. 1 is a prospective view of a sash and window frame.
Figure 2:
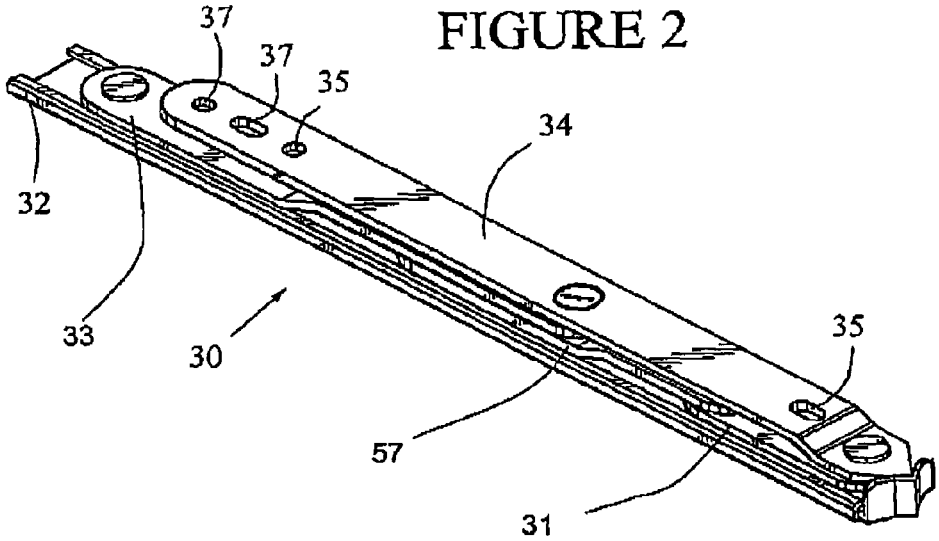
FIG. 2 is a perspective view of a four-bar hinge assembly in a closed position.
Figure 3:
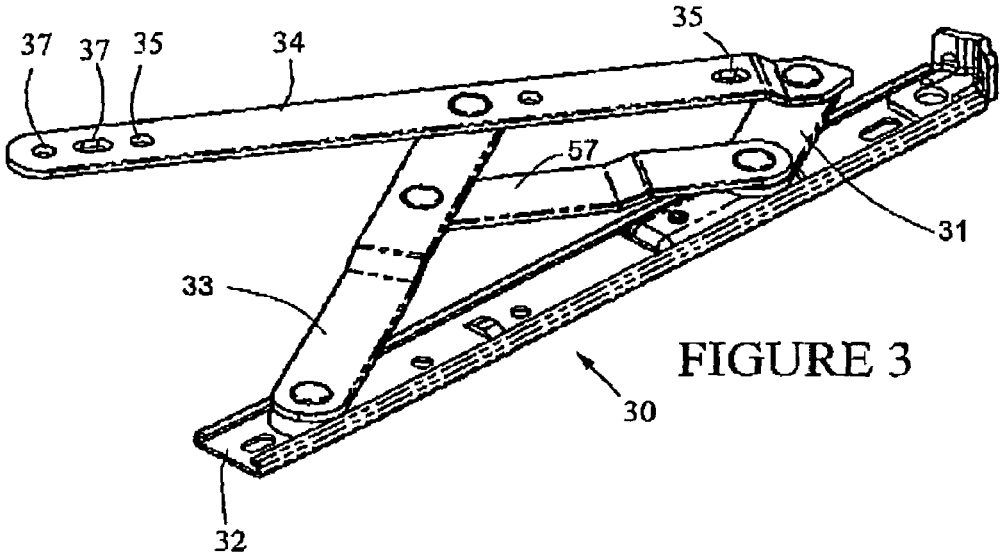
FIG. 3 is a perspective view of the four-bar hinge assembly in a partially open position.
Figure 7:
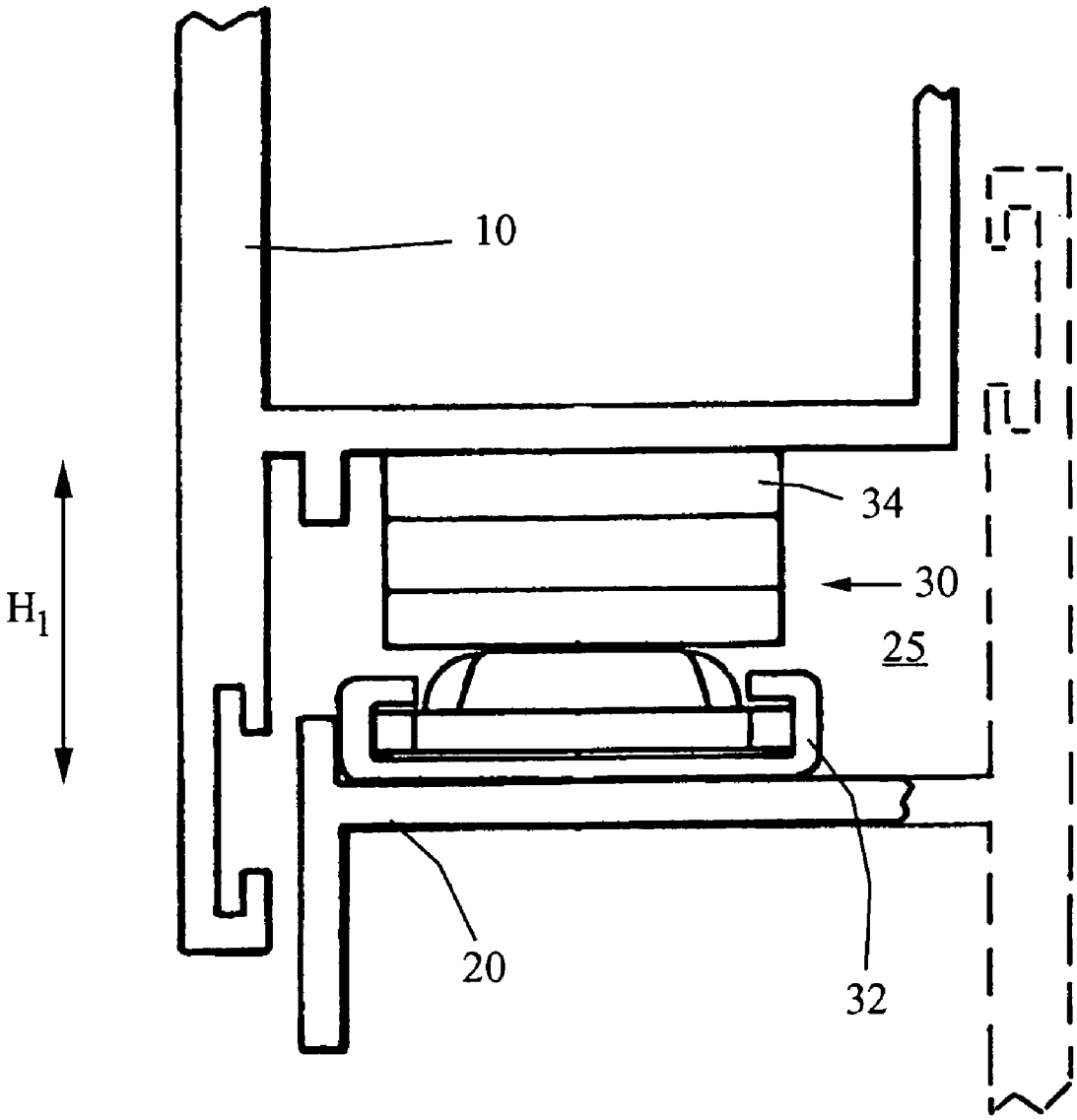
FIG. 7 is a partial cross-sectional view showing a hinge assembly in a given cavity.

Referring to FIG. 1, a window sash 10 is movable relative to a window frame 20. As partially seen in FIG. 1 and further shown in FIGS. 7 and 8, a sash-frame cavity or gap 25 exists between the sash 10 and the frame 20. The sash-frame cavity 25 is sized to include at least one hinge assembly 30. The hinge assembly 30 interconnects the sash 10 to the frame 20 to allow controlled movement of the sash between an open and a closed position. The sash-frame cavity 25 also typically includes a weatherstrip or weatherseal for reducing environmental migration through the gap.

Typically, the hinge assembly 30 is constructed to have a given stack height H for operable location within a corresponding sash-frame cavity. A given hinge assembly 30 can only be employed within a given size sash-frame cavity 25, wherein there are relatively narrow operating tolerances of the hinge assembly. For example, prior hinge assemblies have a stack height of ⅝-inch or three-quarter inch, wherein the ⅝-inch hinge assembly cannot be employed in a sash-frame cavity of approximately three-quarter inches. Any attempts to operate the ⅝-inch stack height hinge assembly in a three-quarter inch gap results in premature failure of the ⅝-inch hinge assembly.

A representative hinge assembly 30 is a four-bar hinge assembly shown in FIGS. 2, 3, 4, and 6–8. Such a hinge assembly includes a track 32 that is affixed to the frame and a vent bar 34 that is affixed to the sash 10. However, it is understood the vent bar 34 can be affixed to the frame 20 and the track 32 connected to the sash 10. As seen in FIGS. 2, 3, 4 and 6, the four bar hinge assembly 30 includes a first link 31, a second link 33 and a third link 57, wherein the first and second links are pivotally connected to the track 32 and the vent bar 34, and the third link is pivotally connected to the track and second link. The vent bar 34 includes a plurality of apertures 35, for receiving a corresponding threaded fastener for affixing the vent bar 34, and hence hinge assembly 30, to the sash 10. The vent bar 34 includes fastening apertures 37 for engaging a shim assembly 40. These fastening apertures 37 and the apertures 35 in the vent bar 34 can be any of a variety of configurations. For example, the apertures 35, 37 can be circular, faceted, curvilinear or obround. It has been found advantageous to employ a circular aperture and a spaced obround aperture 35 in the vent bar 34. With respect to the fastening aperture 37, it has been found satisfactory to employ circular apertures for receiving both the circular and obround engaging tabs.

The present invention includes the shim assembly 40 for releasably engaging the hinge assembly 30 to allow a given hinge assembly to be employed in an otherwise oversized sash-frame cavity 25. The shim assembly 40 includes a shim body 42 and means for releasably engaging the shim body to the hinge assembly 30. Preferably, a shim body 42 is affixed to the hinge assembly 30 at the vent bar 34.

Figure 4:
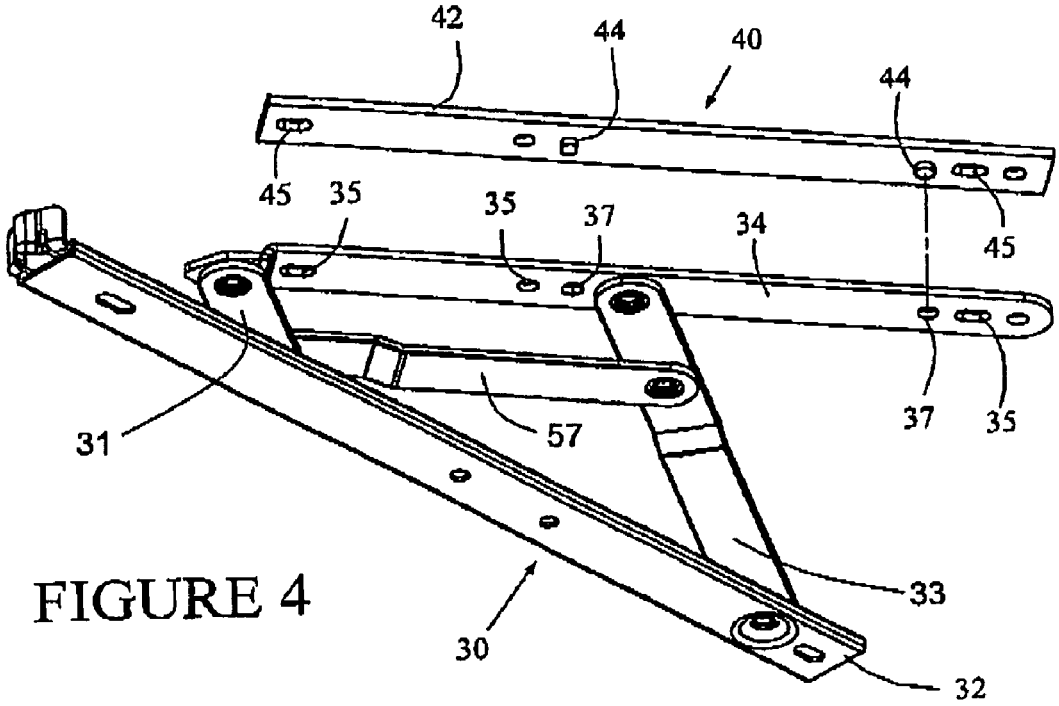
FIG. 4 is a perspective view of one configuration of the shim assembly operably aligned with the four-bar hinge assembly.
Figure 5:
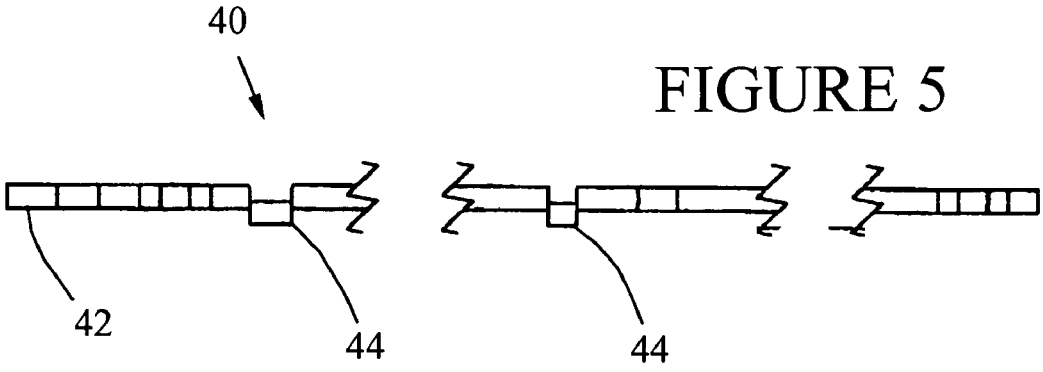
FIG. 5 is a cross-sectional view of the shim assembly of FIG. 4.
Figure 6:
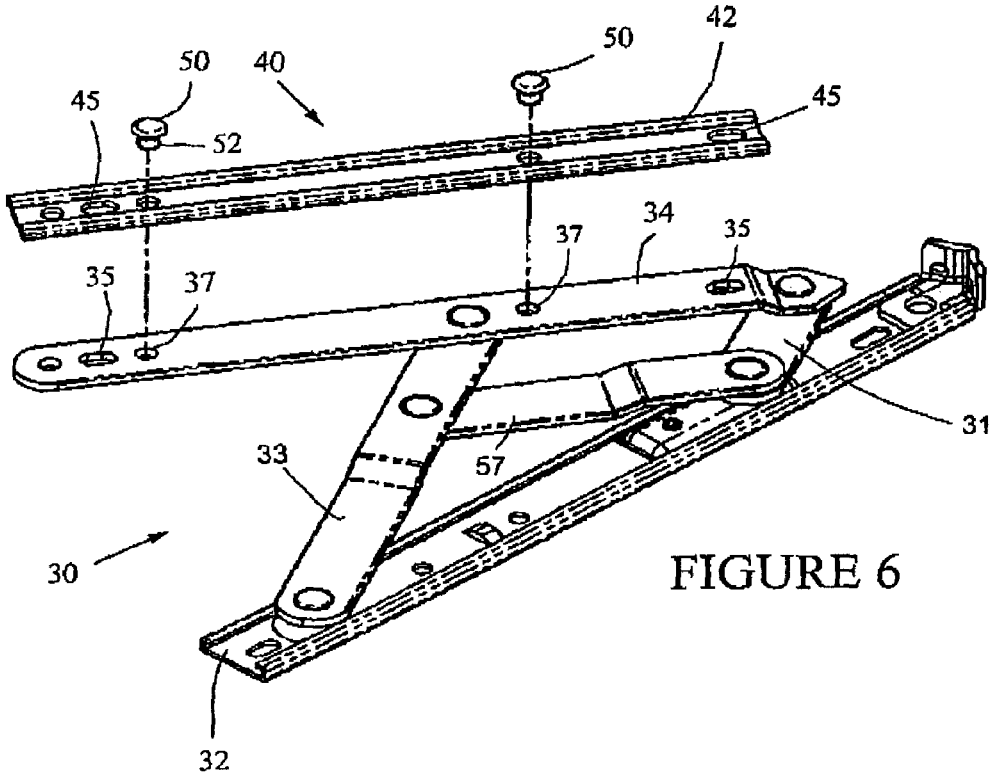
FIG. 6 is an exploded perspective view of an alternative configuration of the shim assembly and the hinge assembly.
Figure 8:
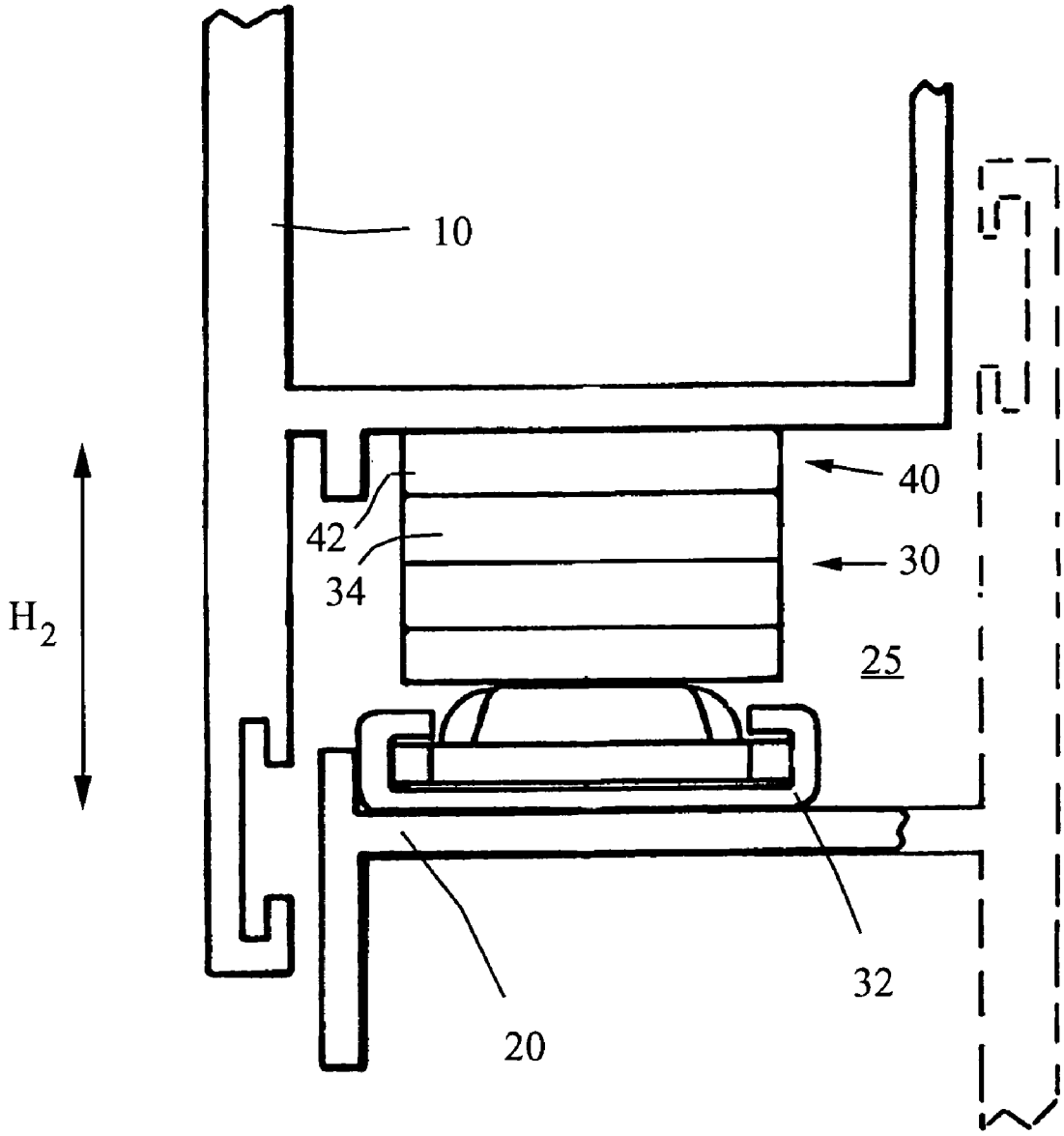
FIG. 8 is a partial cross-sectional view showing the hinge assembly of FIG. 7 in conjunction with the shim assembly in a larger sash-frame cavity.

Referring to FIG. 4, the shim body 42 is an elongate member sized to overlay a substantial portion, both length and width, of the vent bar 34. The shim body 42 also includes fastening apertures 45 for receiving a fastener to engage the shim body with the sash 10. In one configuration, the shim body 42 includes a pair of engaging tabs 44. As seen in FIG. 8, the shim body 42 increases the effective stack height H of the hinge assembly 30. In a preferred configuration, the shim body 42 has a generally rectangular cross section, and corresponds to the cross section of the remaining bar elements in the hinge assembly. The shim body 42 can be formed from a variety of materials including metals, plastics, composites and laminates. The shim body 42 can be extruded, rolled, molded or fabricated. Thus, the hinge body 42 can be a substantially planar member or can be lateral ribs or ridges, as seen in FIG. 6. In a preferred configuration, the shim body is an extruded metal such as aluminum, which is cut to a desired length. Preferably, the length of the shim body 42 is approximately 5% less than the length of the corresponding vent bar 34. The shim body 42 includes fastening apertures 45 aligned with the fastening apertures 35 in the vent bar 34.

The means for releasably engaging the shim assembly 40 with the hinge assembly 30 can include at least one and preferably two engaging tabs 44. In one configuration, the engaging tabs 44 are integrally formed with the shim body 42. That is, the shim body 42 and engaging tabs 44 are formed of a single, contiguous piece of material. The engaging tabs 44 can be formed by pressing or punching the shim body to cause the material to form the engaging tab, while a corresponding recess is formed in an opposing side of the shim body.

While the engaging tabs 44 can be any of a variety of configurations, the engaging tabs can correspond to the respective apertures 37 in the vent bar 34. The engaging tabs 44 can have any of a variety of cross sections including, but not limited to, circular or non circular including oval, faceted, curvilinear, obround or oblong. In one configuration, the shim assembly 40 includes a first projecting tab 44 having a circular cross section and a second projecting tab having a non circular cross section such as an obround cross section. Referring to FIG. 4, an obround tab 44 is received within a circular aperture 37.

Figure 9:
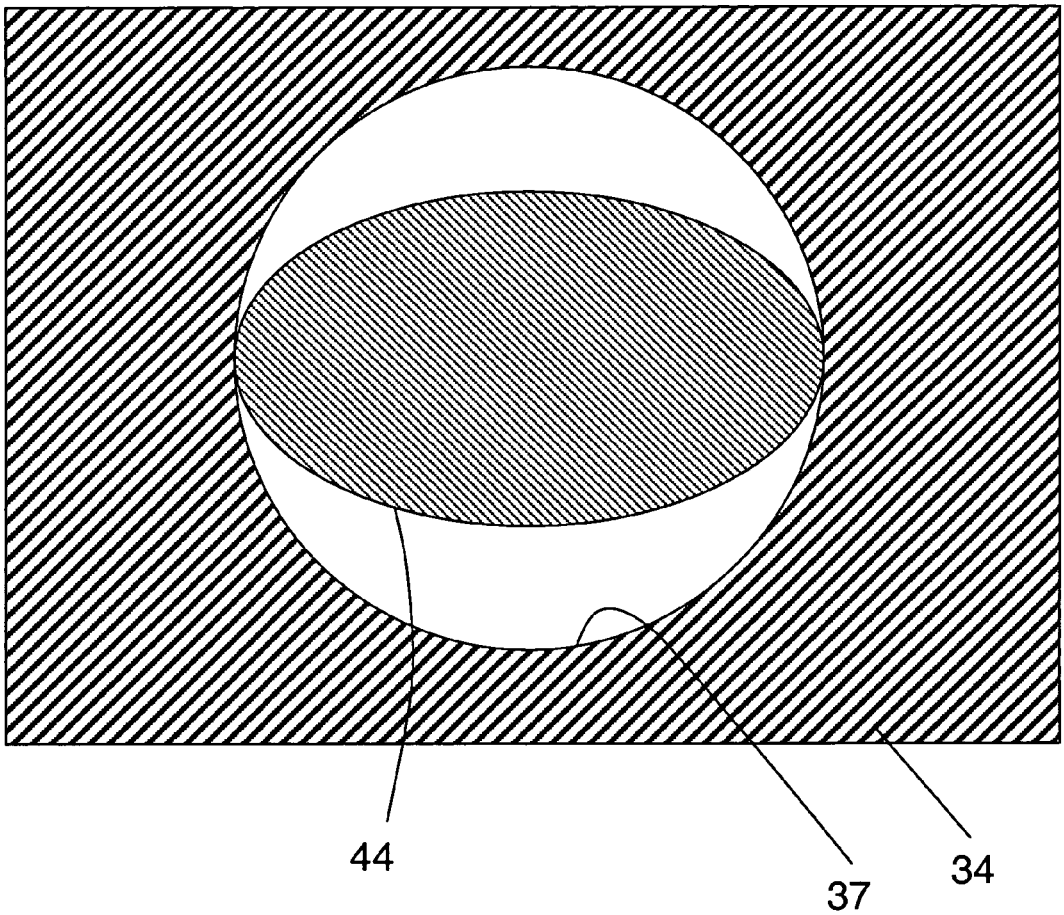
FIG. 9 is a schematic representation of non circular projecting tab engaging a circular aperture the hinge assembly.

The sizing of the engaging tab 44 with respect to the corresponding aperture 37 in the vent bar 34 is selected to facilitate the engagement and preferably releasable engagement of the shim assembly and the hinge assembly. Specifically, the engaging tab 44, having a circular cross section, is sized such that the cross section of the tab is slightly less than the cross section of the circular aperture 37 in the vent bar. Thus, the engaging tab 44 slides into the corresponding aperture 37 and the shim body 42 can be rotated relative to the vent bar 34. Referring to FIG. 9, the obround (non circular) engaging tab 44 is sized to be received within the corresponding circular aperture 37 in the vent bar. With respect to the circular aperture 37, the non circular projecting tab 44 has a reduced area (length) of contact with the wall of the aperture. This reduced amount of contact allows for accommodation of manufacturing tolerances between (i) the spacing of the apertures 37 in the vent bar 34, (ii) the sizing of the apertures in the vent bar, (iii) the sizing of the projecting tabs 44 and (iv) the spacing of the projecting tabs. By reducing the designed contact area between the projecting tabs 44 and the corresponding aperture 37 (having a non similar periphery), the tolerances can be accommodated by slight deformation at the resulting interface. That is, a hand insertion (engaging) force will be sufficient to urge the non circular projecting tab 44 into the circular aperture 37, as the amount of contact between the shim and the vent bar is reduced.

Generally stated, one of the projecting tabs 44 has a non similar cross section to the corresponding aperture 37 into which the projecting tab is received. Although only one projecting tab 44 is set forth as non circular (for engaging a corresponding circular aperture), it is understood both projecting tabs can be non circular for engaging circular apertures 37 in the vent bar, thereby reducing the amount of contact between the projecting tab and the wall of the aperture. Thus, one or both of the projecting tabs 44 can have dissimilar cross section than the corresponding aperture 37 in the hinge assembly. By the description as dissimilar cross sections, it is understood that reorientation of otherwise similar cross sections could result in present dissimilar relation. That is, for the aperture 37 being square, the projecting tab 44 also may have a square cross section; however if the projecting tab is rotated 45° relative to the aperture 37 and reduced in size so that the diagonals of the tab contact the walls of the aperture, then such cross sections are dissimilar. It is further understood that dissimilar can pertain to the dimensional interference of similar cross sections, such as circular cross sections where rotating is irrelevant.

In an alternative configuration, the shim body 42 can be connected to the vent bar 34 by means of a snap rivet 50. In this configuration, the engaging tabs 44 are not formed on the shim body 42 and instead rivet apertures 47 are provided in the shim body. The snap rivet 50 is a generally T-shape member having a post 52 sized to pass through the aperture 47 in the shim body 42 and engage the aperture 37 in the vent bar 34. The post 52 is sized to provide an interference fit with the aperture 37 in the vent bar 34 such that the shim body 42 is sufficiently retained relative to the vent bar 34 to allow a fastener to pass through the vent bar 34 and the shim body and engage the sash 10 (or the frame 20).

In one configuration, the shim assembly 40 can be manually attached to the vent bar 34, wherein the retention force is sufficient to allow shipping and installation of the hinge assembly 30 with the shim assembly. Thus, the shim assembly can be removed non-destructively from the hinge assembly.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

The invention claimed is:

1. A shim assembly for engaging a hinge having a vent bar, the vent bar including a first and a spaced apart second aperture, the shim assembly comprising:

(a) a four bar hinge assembly including a vent bar, a first link, a second link, a third link and a track, the vent bar including a first aperture and a spaced apart second aperture; and (b) an elongate shim body having a first projecting tab sized to be received within the first aperture of the vent bar and a spaced apart second projecting tab sized to be received within the second aperture of the vent bar.

2. The shim assembly of claim 1, wherein the first projecting tab has a circular cross section and is sized to be slidably received within the first aperture.

3. The shim assembly of claim 2, wherein the first and the second apertures have a circular cross section and one of the first and the second projecting tabs forms an interference fit in one of the corresponding first and second apertures.

4. The shim assembly of claim 1, wherein the second projecting tab has a non circular cross section and is sized to be received within the second aperture.

5. The shim assembly of claim 4, wherein the cross section of the second projecting tab is one of obround, oval and oblong.

6. The shim assembly of claim 5, wherein the second aperture has a circular cross section.

7. The shim assembly of claim 6, wherein the cross section of the second projecting tab is sized to be received in the circular cross section of the second aperture.

8. A shim assembly comprising:

(a) a four bar hinge assembly including a vent bar having an aperture, a first link, a second link, a third link and a track;

(b) an elongate one-piece shim body having a thickness; and (c) at least a first projecting tab integrally formed with the shim body, the first projecting tab sized to be at least partially received within the aperture to releasably connect the shim body to the vent bar.

9. The shim assembly of claim 8, further comprising a second projecting tab integrally formed with the shim body.

10. The shim assembly of claim 9, wherein the first projecting tab has a circular cross section and the second projecting tab has a non circular cross section.

11. The shim assembly of claim 8, wherein the first projecting tab extends from a first side of the shim body and the shim body includes a recess at a corresponding location on a second side.

12. The shim assembly of claim 8, wherein the aperture in the vent bar has a circular cross section and is sized to receive a projecting tab having a non circular cross section.

13. A configurable hinge system for mounting between a window sash and a frame, comprising:

(a) a four bar hinge assembly having a first stack height, the four bar hinge assembly including a vent bar, a first link, a second link, a third link and a track, the vent bar for securing to the window sash; and (b) a shim non-destructively, removably connected to the vent bar, one of the shim and the vent bar having an aperture and the other of the shim and the vent bar having a projecting tab sized to engage the aperture to form an interference fit.

14. A method of converting a four bar hinge assembly of a first stack height to have a greater second stack height, the method comprising:

(a) engaging a projecting tab on a shim of a predetermined thickness, the projecting tab of a first cross section, to an aperture in the four bar hinge assembly, the four bar hinge assembly including a vent bar, a first link, a second link, a third link and a track, the first link and the third link connected to the each of the vent bar and the track, and the third link connected to the track and the second link, the aperture having a non similar cross section, to provide the second stack height of the hinge assembly.

15. The method of claim 14, further comprising connecting the shim to the vent bar of the four-bar hinge assembly.

16. The method of claim 14, further comprising engaging a non circular projecting tab on the shim with a circular aperture in the vent bar.

* * * * *